US009149130B2

(12) United States Patent
Yuen

(10) Patent No.: US 9,149,130 B2
(45) Date of Patent: Oct. 6, 2015

(54) ILLUMINATING DEVICE FOR SHOWCASE

(71) Applicant: DONGGUAN HENG LONG FIXTURE MANUFACTURING COMPANY LIMITED, Dongguan (CN)

(72) Inventor: Hiu Ming Yuen, Dongguan (CN)

(73) Assignee: Dongguan Heng Long Fixture Manufacturing Company Limited, Dongguan (CN)

( * ) Notice: Subject to any disclaimer, the term of this patent is extended or adjusted under 35 U.S.C. 154(b) by 185 days.

(21) Appl. No.: 13/959,760

(22) Filed: Aug. 6, 2013

(65) Prior Publication Data

US 2014/0185276 A1 Jul. 3, 2014

(30) Foreign Application Priority Data

Jan. 3, 2013 (CN) ..... 2013 1 0002770

(51) Int. Cl.

| | |
|---|---|
| ***A47F 3/00*** | (2006.01) |
| ***F21K 99/00*** | (2010.01) |
| ***F21V 33/00*** | (2006.01) |
| ***F21V 21/35*** | (2006.01) |
| ***F21V 21/00*** | (2006.01) |
| ***A47F 11/10*** | (2006.01) |

(52) U.S. Cl.

CPC ..... *A47F 3/001* (2013.01); *A47F 11/10* (2013.01); *F21V 21/00* (2013.01); *F21V 21/35* (2013.01); *F21V 33/0012* (2013.01); *A47B 2220/0077* (2013.01)

(58) Field of Classification Search

CPC ..... A47F 3/00; A47F 3/001; F21V 21/00; F21V 21/35; F21V 33/0012; A47B 2220/0077

See application file for complete search history.

(56) References Cited

U.S. PATENT DOCUMENTS 7,824,057 B2 * 11/2010 Shibusawa et al. ..... 362/125

* cited by examiner

*Primary Examiner* — Joseph L Williams

(74) *Attorney, Agent, or Firm* — Mark M. Friedman

(57) ABSTRACT

An illuminating device includes an aluminum extrusion profile fixed on a back panel of a showcase, and a lamp device. A face panel of the showcase is secured to an end of the aluminum extrusion profile away from the back panel. In the middle of the aluminum extrusion profile defines a sliding slot extending horizontally. The face panel defines an elongated slot corresponding to the sliding slot. The lamp device includes a lamp and a conductive head. A conductive structure is secured to the sliding slot for allowing the conductive head to be plugged therein and conduct the conductive head. The conductive head can slide along the sliding slot to be located at any desired position to illuminate objects on the showcase. A ratchet connecting mechanism is arranged on the sliding slot and configured to mount and remove the conductive head.

18 Claims, 6 Drawing Sheets

ILLUMINATING DEVICE FOR SHOWCASE

BACKGROUND

1. Technical Field

The present disclosure relates to illuminating devices, and more particularly to an illuminating device for showcases.

2. Description of Related Art

Chinese patent (CN201977332U) filed on Jan. 18, 2011 by Applicant of this invention discloses an illuminating shelf for showcases. In this Chinese patent, how to supply power to a lamp in a showcase, and how to conceal wires to make the showcase look more discreet Furthermore, in the Chinese patent, a left support and a right support of the illuminating shelf can be adjusted upward and downward in relation to the floor. The structure of the illuminating shelf is simple, and easy to assemble. Thus, we were able to lower our cost and installation time.

However, in the Chinese patent, light cannot be emitted to different orientations, thus the illuminating shelf cannot be used in larger showcases or showcases to show different products. Furthermore, the Chinese patent does not disclose how to mount a number of lamps in a horizontal plane.

Therefore, there is a room for improvement in the design.

SUMMARY

Embodiments of the present invention relate to an illuminating device for a showcase. The illuminating device is capable of being moveably located on any desired positions and being mounted and removed randomly.

An embodiment of the illuminating device for a showcase having a back panel and a face panel is provided. The illuminating device includes an aluminum extrusion profile fixed on the back panel of a showcase, and a lamp device. The face panel of the showcase is secured to an end of the aluminum extrusion profile away from the back panel. In the middle of the aluminum extrusion profile defines a sliding slot extending horizontally. The face panel defines an elongated slot corresponding to the sliding slot. The lamp device includes a lamp and a conductive head. A conductive structure is secured to the sliding slot for allowing the conductive head to be plugged therein and conduct the conductive head. The conductive head can slide along the sliding slot to be located at any desired positions to illuminate objects on the showcase. A ratchet connecting mechanism is arranged on the sliding slot and configured to mount and remove the conductive head, thereby the lamp device can be mounted and removed randomly.

Wherein the mentioned above ratchet connecting mechanism includes at least one ratchet bar arranged on an inner upper sidewall of the sliding slot, at least one outer ratchet bar arranged on an outer lower sidewall of the sliding slot, at least one inner ratchet set on an inner upper sidewall of the conductive head and engageable with the inner ratchet bar, and at least one outer ratchet set on an outer lower sidewall of the conductive head and engageable with the outer ratchet bar.

Wherein the mentioned above sliding slot includes an inner upper sidewall and an inner lower sidewall. The inner upper sidewall includes an upper inclined portion and an inner portion. The inner lower sidewall includes an outer portion and a lower inclined portion. The upper inclined portion is parallel to the lower inclined portion and inclines upwardly relative to the back panel.

Wherein the mentioned above inner ratchet bar is arranged on the inner upper sidewall of the sliding slot, and the mentioned above outer ratchet bar is arranged on the outer lower sidewall of the sliding slot.

Wherein the teeth of the mentioned above inner rack and the outer rack incline toward an inner end of the sliding slot adjacent to the back panel.

Wherein the mentioned above conductive structure includes an insulation slot arranged on an upper sidewall of the sliding slot, a positive conductive bar and a negative conductive bar parallel to the positive conductive bar are set in an inner wall of the insulation slot away from the sliding slot; a positive ball and a negative ball are set in an upper sidewall of the conductive head, the positive ball corresponds to and abuts the positive conductive bar, and the negative ball corresponds to and abuts the negative conductive bar.

Wherein the mentioned above insulation slot is made of insulation material, the mentioned above positive conductive bar and the negative conductive bar are made of copper.

By virtue of the mentioned above conductive structure, the lamp device of the illuminating device can slide along the sliding slot back and forth, thus the lamp device is moveably located at any desired positions to illuminate objects in the showcase. As a result, the illuminating device of the present invention is used conveniently to illuminate objects on the showcase.

BY virtue of the mentioned above ratchet connecting mechanism, the lamp device can be mounted and removed, easily and conveniently. To remove the lamp device, the lamp is raised, such that the inner ratchet disengages with the inner rack and the outer ratchet disengages with the outer rack. As a result, the lamp device can be removed. To mount the lamp device, the conductive head is plugged/inserted into the sliding slot, with the positive ball abutting the positive conductive bar and the negative ball abutting the negative conducive bar, to conduct the lamp device. Then, the lamp device is released, and by virtue of the gravity of the lamp device, an inner end of the conductive head away from the lamp raises, and an outer end of the conductive head adjacent to the lamp descends. As a result, the inner ratchet engages with the inner rack and the outer ratchet engages with the outer rack, the lamp device is mounted to the showcase.

Furthermore, the configuration of the upper inclined portion being parallel to the lower inclined portion and inclining upwardly relative to the back panel, cooperates with the mentioned above ratchet connecting mechanism, whereby the operations of the illuminating device can be easy and convenient.

The following detailed description, together with the accompanying drawings will provide a better understanding of the nature and advantages of the present invention.

BRIEF DESCRIPTION OF THE DRAWINGS

The embodiments can be understood with reference to the following drawings. The components in the drawings are not necessarily drawn to scale, the emphasis instead being placed upon clearly illustrating the principles of the embodiments. Moreover, in the drawings, like reference numerals designate corresponding parts throughout several views.

DETAILED DESCRIPTION

The disclosure is illustrated by way of example and not by way of limitation in the figures of the accompanying drawings in which like reference indicate similar elements.

Figure 1:
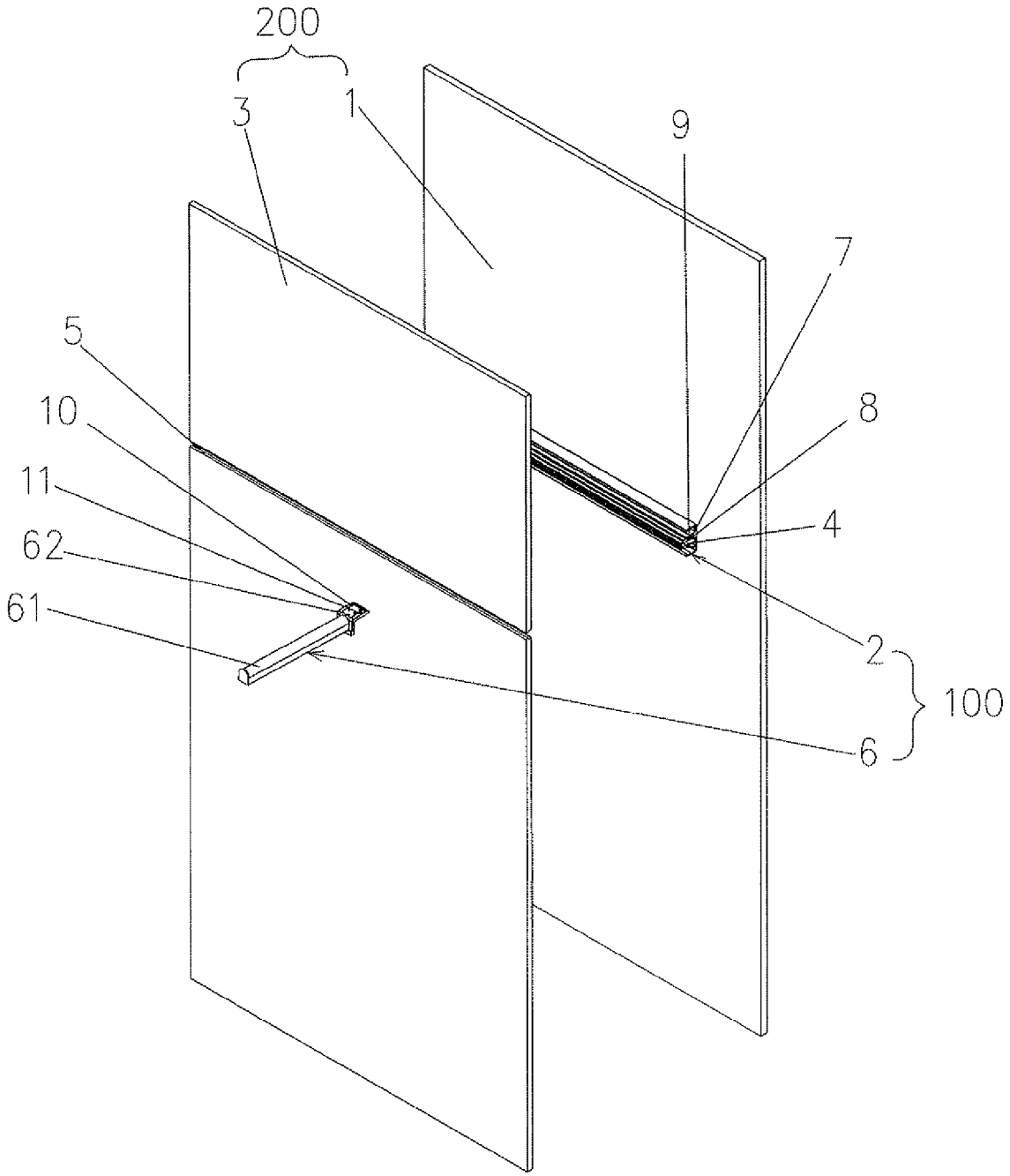
FIG. 1 is an exploded, perspective view of an illuminating device for a showcase, in accordance with an exemplary embodiment.
Figure 2:
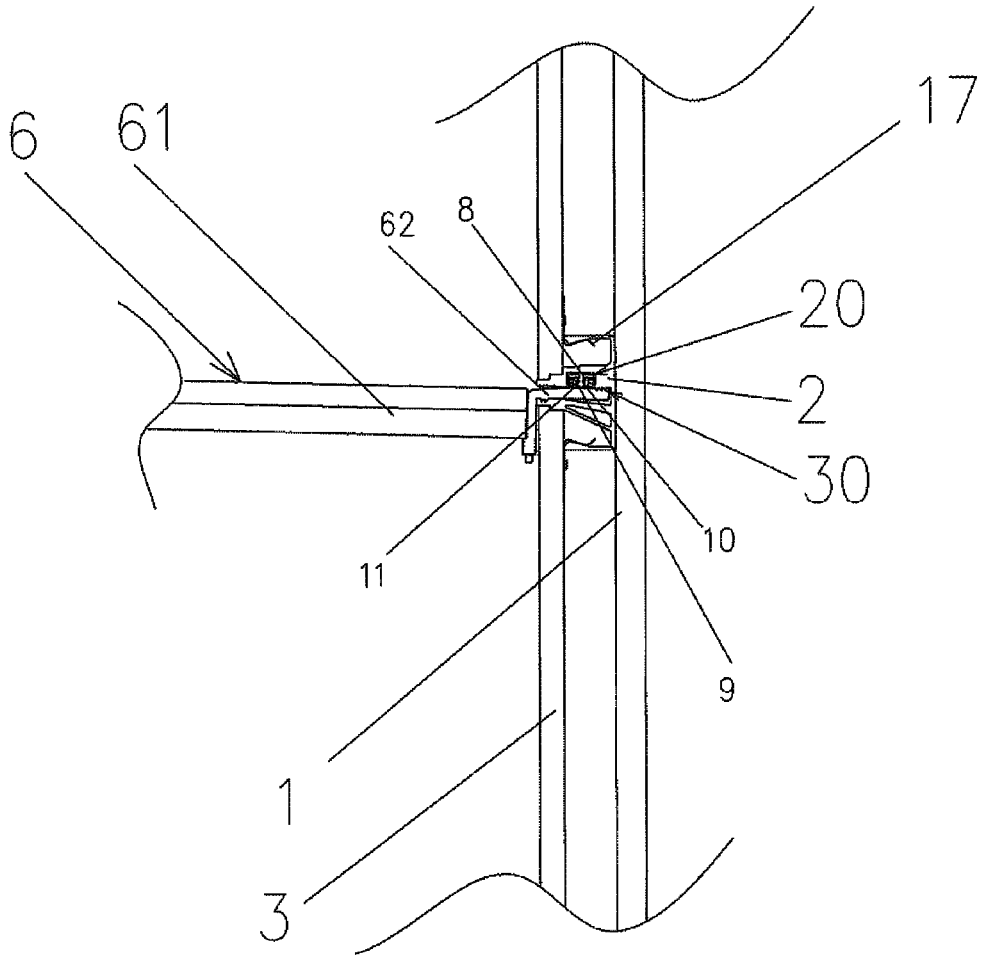
FIG. 2 is a cross-sectional view of the illuminating device of FIG. 1.
Figure 3:
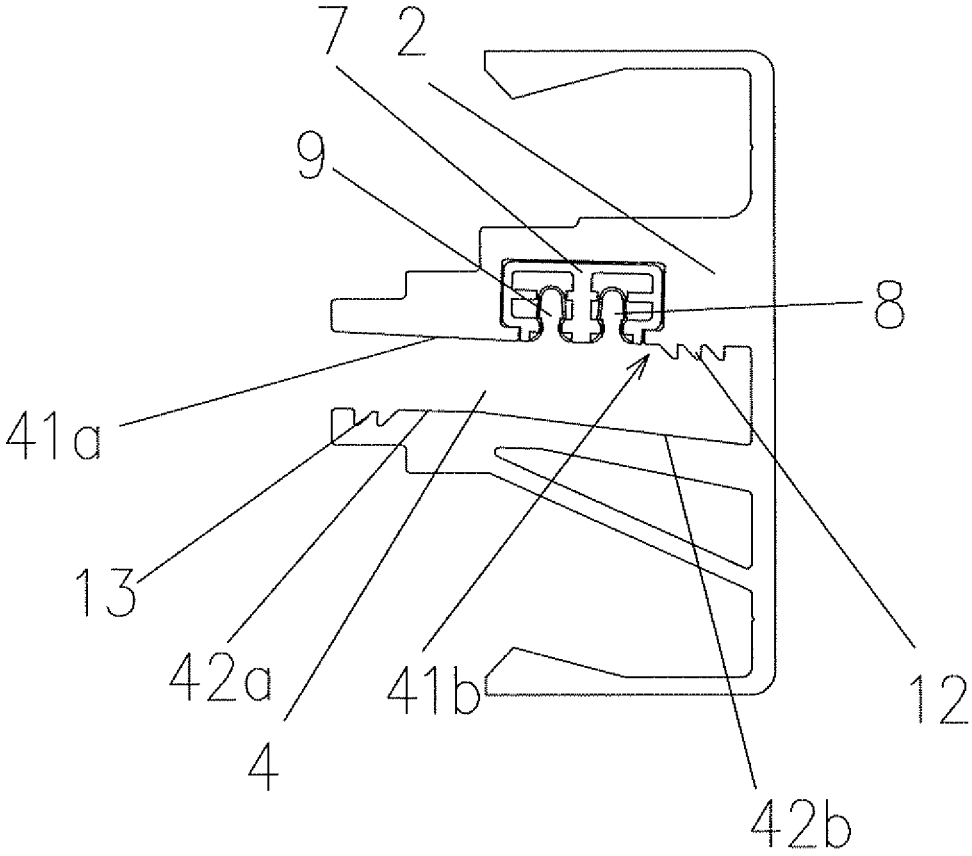
FIG. 3 is a front view of an aluminum extrusion profile of the illuminating device of FIG. 1.
Figure 4:
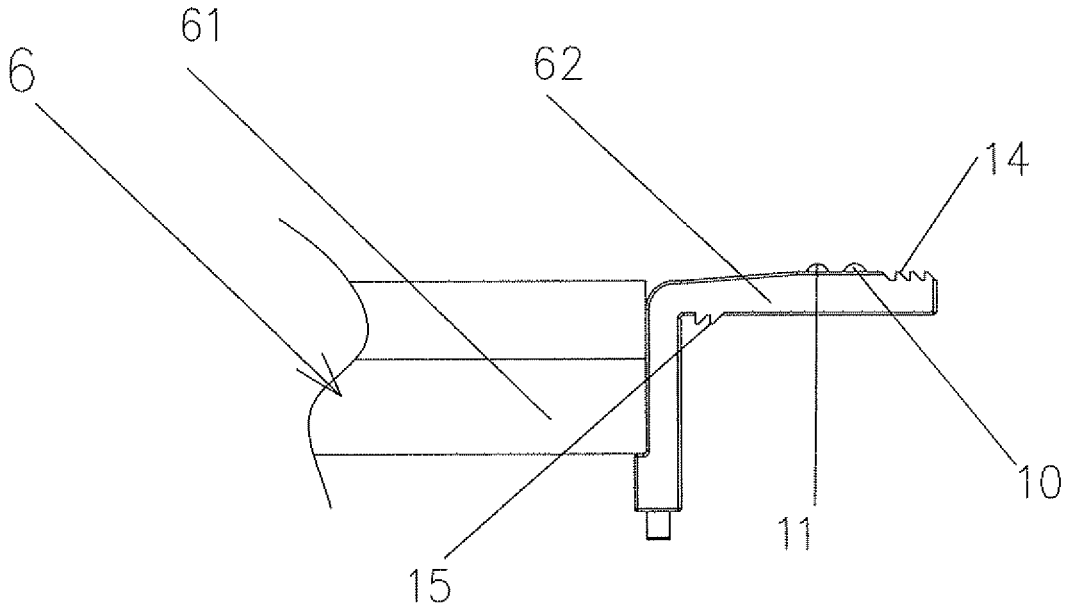
FIG. 4 is an isometric view of a conductive head of the illuminating device of FIG. 1.
Figure 5:
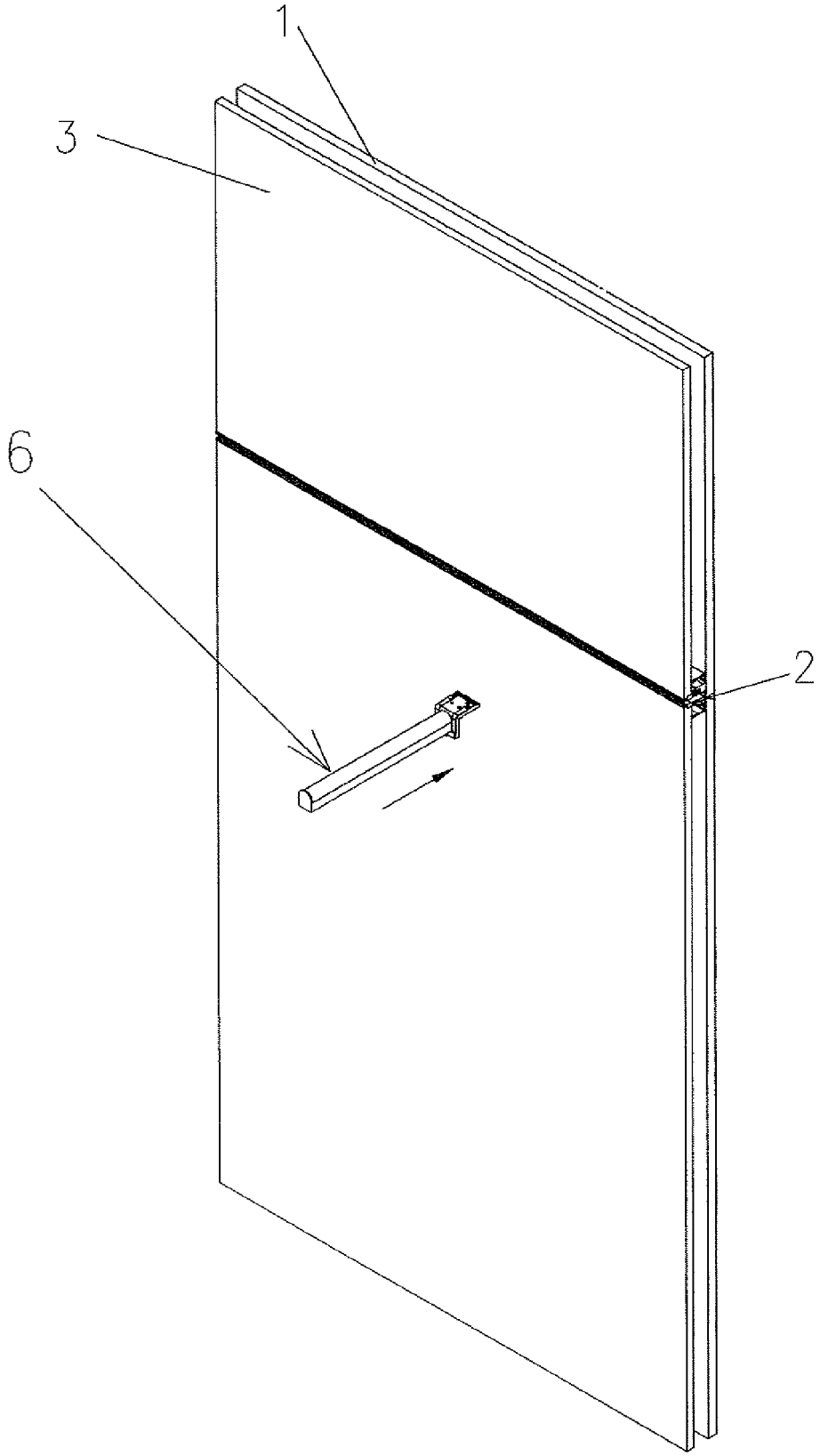
FIG. 5 is an isometric view of the illuminating device of FIG. 1, showing that a lamp device will be mounted to the showcase of FIG. 1.
Figure 6:
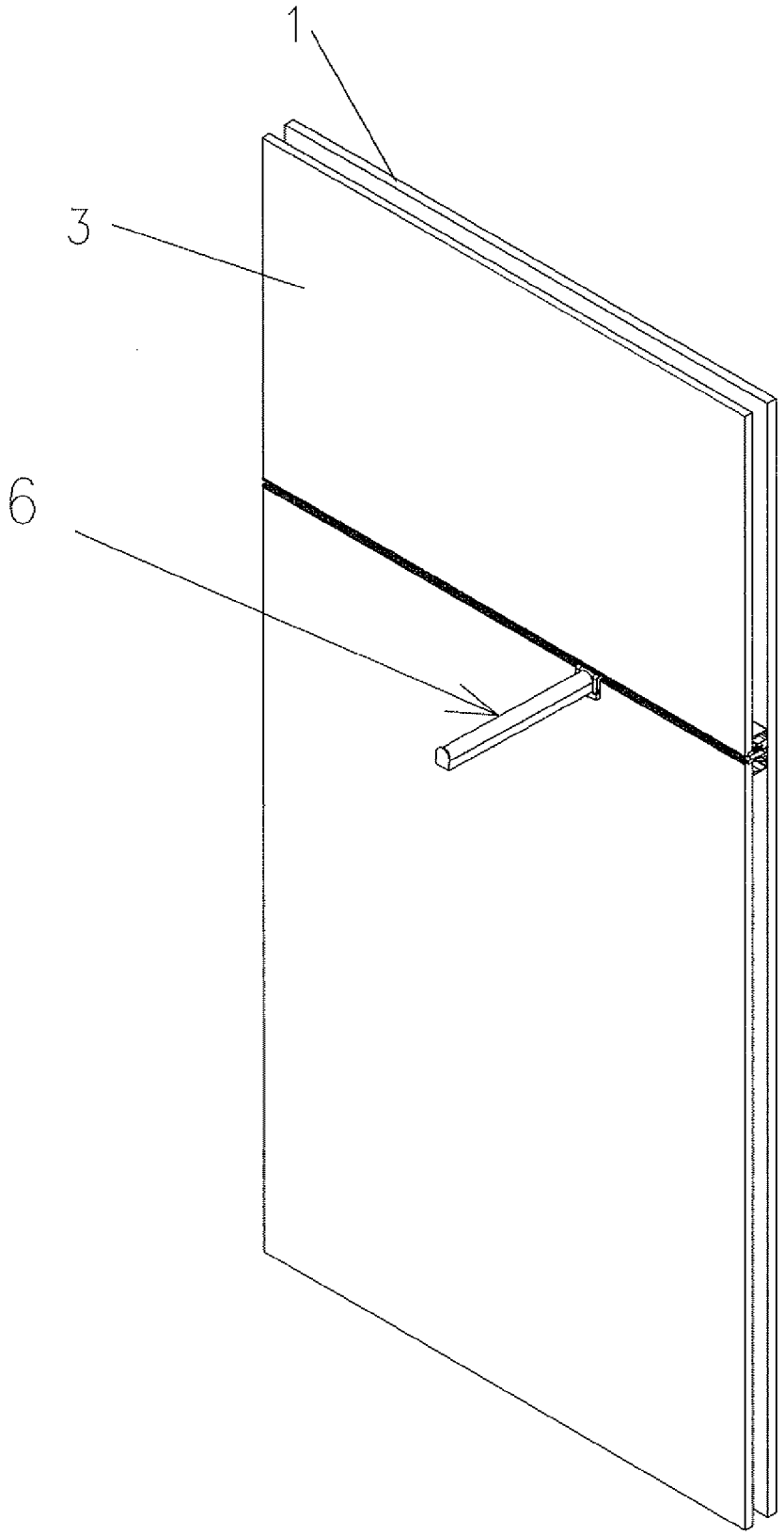
FIG. 6 is another isometric view of the illuminating device of FIG. 1, showing that the lamp device has been mounted to the showcase of FIG. 1.

Referring to the FIG. 1, an embodiment of an illuminating device 100 for a showcase 200 having a face panel 3 and a back panel 1 is illustrated. The illuminating device 100 includes an aluminum extrusion profile 2 fixed on the back panel 1 of the showcase 200. The face panel 3 is secured to an end of the aluminum extrusion profile 2 away from the back panel 1 and is parallel to the back panel 1. In the middle of the aluminum extrusion profile 2 defines a sliding slot 4. The sliding slot 4 extends horizontally along the aluminum extrusion profile 2. The face panel 3 defines an elongated slot 5 corresponding to the sliding slot 4.

The illuminating device 100 further includes a lamp device 6. The lamp device 6 includes a lamp 61 and a conductive head 62 for electrically connecting the lamp 61 to a power supply (not shown). The conductive head 62 is capable of being inserted into the sliding slot 4 via the elongated slot 5. A conductive structure 20 is arranged in the sliding slot 4. The conductive head 62 is conductive when inserted into the conductive structure 20 and can slide along the sliding slot 4 by virtue of the conductive structure. With such configuration, the lamp device 6 can slide along the sliding slot 4. Accordingly, the lamp device 6 can slide to be located at any desired position to illuminate objects in the showcase 200.

In detail, the conductive structure 20 includes an insulation slot 7 defined on an upper sidewall of the sliding slot 4. A positive conductive bar 8 and a negative conductive bar 9 are set in an inner sidewall of the insulation slot 7 away from the sliding slot 4. The negative conductive bar 9 is parallel to the positive conductive bar 8. A positive ball 10 and a negative ball 11 are set in an upper sidewall of the conductive head 62. When the conductive head 62 is inserted into the sliding slot 4, the positive ball 10 electrically contacts with the positive conductive bar 8, and the negative ball 11 electrically contacts with the negative conductive bar 9. With such configuration, when the conductive head 62 slides, the positive ball 10 abuts and slides along the positive conductive bar 8, and the negative ball 10 abuts and slides along the negative conductive bar 9.

The illuminating device 100 further includes a ratchet connecting mechanism 30 for mounting and removing the lamp device 6. In detail, the ratchet connecting mechanism 30 includes an inner rack 12 arranged on an inner upper sidewall of the sliding slot 4 and an outer rack 13 arranged on an outer lower sidewall of the sliding slot 4. An inner ratchet 14 engageable with the inner rack 12 is set on an inner upper sidewall of the conductive head 62. An outer ratchet 15 engageable with the outer rack 15 is set on an outer lower sidewall of the conductive head 62. With the engagement between the inner rack 12 and the inner ratchet 14, and the engagement between the outer rack 13 and the outer ratchet 15, it is convenient to mount the lamp device 6 on the illuminating device 100 and remove the lamp device 6 from the illuminating device 100.

In detail, to remove the lamp device 6 from the illuminating deice, an outer portion of the lamp device 6 away from the conductive head 62 is raised, causing the inner ratchet 14 to disengage with the inner rack 12, and the outer ratchet 15 to disengage with the outer rack 13. At this point, the conductive head 62 can be taken out from the sliding slot 4, and the lamp device 6 can be removed.

To mount the lamp device 6, the conductive head 62 is plugged/inserted into the sliding slot 4, with the positive ball 10 abutting the positive conductive bar 8 and the negative ball 11 abutting the negative conducive bar 9, to conduct the lamp device 6. Then, the lamp device 6 is released, and by virtue of the gravity of the lamp device 6, an inner end of the conductive head 62 away from the lamp 61 raises, and an outer end of the conductive head 62 adjacent to the lamp 61 descends. As a result, the inner ratchet 14 engages with the inner rack 12, and the outer ratchet 15 engages with the outer rack 13. At this point, the conductive head 62 is fixed in the sliding slot 4, and cannot be pulled out from the sliding slot 4.

In detail, the inner upper sidewall of the sliding slot 4 includes an upper inclined portion 41*a* and an inner portion 41*b*. The inner lower sidewall of the sliding slot 4 includes an outer portion 42*a* and a lower inclined portion 42*b*. The upper inclined portion 41*a* is parallel to the lower inclined portion 42*b* and inclines upwardly relative to the back panel 1. With such configuration, when the conductive head 62 is inserted into the sliding slot 4 with an inclined angle, the engagement between the inner ratchet 14 and the inner rack 12, and the engagement between the outer ratchet 15 and the outer rack 13 can be avoided.

In this embodiment, the inner rack 12 protrudes outwardly from the inner upper sidewall of the sliding slot 4, and the outer rack 13 is dented inwardly from the outer lower sidewall of the sliding slot 4.

In this embodiment, the teeth of the inner rack 12 and the outer rack 13 incline toward an inner end of the sliding slot 4 adjacent to the back panel 1.

In this embodiment, the insulation slot 7 is made of insulation material. The positive conductive bar 8 and the negative conductive bar 9 are made of copper.

In this embodiment, a latching element 17 is arranged on a back side of the face panel 3, and the latching element 17 latches the aluminum extrusion profile 2.

Although information as to, and advantages of, the present embodiments have been set forth in the foregoing description, together with details of the structures and functions of the present embodiments, the disclosure is illustrative only; and changes may be made in detail, especially in the matters of Shape, size, and arrangement of parts within the principles of the present embodiments to the full extent indicated by the broad general meaning of the terms in which the appended claims are expressed.

What is claimed is:

1. An illuminating device for a showcase having a back panel and a face panel, comprising:

an aluminum extrusion profile fixed on the back panel, wherein the end of the aluminum extrusion profile away from the back panel is secured to the face panel, in the middle of the aluminum extrusion profile defines a sliding slot extending horizontally, the face plate defining an elongated slot corresponding to the sliding slot; and a lamp device comprising a lamp and a conductive head capable of being plugged into the sliding slot via the elongated slot;

wherein a conductive structure is secured to the sliding slot for allowing the conductive head to be plugged therein and conduct the conductive head, the conductive head is capable of sliding along the sliding slot to be located at any desired positions to illuminate objects on the showcase; a ratchet connecting mechanism is arranged on the sliding slot and configured to mount and remove the conductive head.

2. The illuminating device of claim 1, wherein the ratchet connecting mechanism comprises at least one ratchet bar arranged on an inner upper sidewall of the sliding slot, at least one outer ratchet bar arranged on an outer lower sidewall of the sliding slot, at least one inner ratchet set on an inner upper sidewall of the conductive head and engageable with the inner ratchet bar, and at least one outer ratchet set on an outer lower sidewall of the conductive head and engageable with the outer ratchet bar.

3. The illuminating device of claim 2, wherein the inner upper sidewall of the sliding slot comprises an upper inclined portion and an inner portion, the inner lower sidewall of the sliding slot comprises an outer portion and a lower inclined portion, the upper inclined portion is parallel to the lower inclined portion and inclines upwardly relative to the back panel.

4. The illuminating device of claim 2, wherein the inner ratchet bar is arranged on the inner upper sidewall of the sliding slot, and the outer ratchet bar is arranged on the outer lower sidewall of the sliding slot.

5. The illuminating device of claim 3, wherein the inner ratchet bar is arranged on the inner upper sidewall of the sliding slot, and the outer ratchet bar is arranged on the outer lower sidewall of the sliding slot.

6. The illuminating device of claim 2, wherein the teeth of the inner rack and the outer rack incline toward an inner end of the sliding slot adjacent to the back panel.

7. The illuminating device of claim 3, wherein the teeth of the inner rack and the outer rack incline toward an inner end of the sliding slot adjacent to the back panel.

8. The illuminating device of claim 2, wherein the conductive structure comprises an insulation slot arranged on an upper sidewall of the sliding slot, a positive conductive bar and a negative conductive bar parallel to the positive conductive bar are set in an inner wall of the insulation slot away from the sliding slot, a positive ball and a negative ball are set in an upper sidewall of the conductive head, the positive ball corresponds to and abuts the positive conductive bar, and the negative ball corresponds to and abuts the negative conductive bar.

9. The illuminating device of claim 3, wherein the conductive structure comprises an insulation slot arranged on an upper sidewall of the sliding slot, a positive conductive bar and a negative conductive bar parallel to the positive conductive bar are set in an inner wall of the insulation slot away from the sliding slot; a positive ball and a negative ball are set in an upper sidewall of the conductive head, the positive ball corresponds to and abuts the positive conductive bar, and the negative ball corresponds to and abuts the negative conductive bar.

10. The illuminating device of claim 8, wherein the insulation slot is made of insulation material, the positive conductive bar and the negative conductive bar are made of copper.

11. The illuminating device of claim 9, wherein the insulation slot is made of insulation material, the positive conductive bar and the negative conductive bar are made of copper.

12. A showcase, comprising:

a back panel:

an aluminum extrusion profile fixed on the back panel, wherein In the middle of the aluminum extrusion profile defines a sliding slot extending horizontally; and a lamp device comprising a lamp and a conductive head capable of being plugged into the sliding slot via the elongated slot;

wherein a conductive structure is secured to the sliding slot for allowing the conductive head to be plugged therein and conduct the conductive head, the conductive head is capable of sliding along the sliding slot to be located at any desired positions to illuminate objects on the showcase; a ratchet connecting mechanism is arranged on the sliding slot and configured to mount and remove the conductive head.

13. The showcase of claim 12, further comprising a face panel, wherein an end of the aluminum extrusion profile away from the back panel is secured to the face panel, the face panel defines an elongated slot corresponding to the sliding slot.

14. The showcase of claim 12, wherein ratchet connecting mechanism comprises at least one ratchet bar arranged on an inner upper sidewall of the sliding slot, at least one outer ratchet bar arranged on an outer lower sidewall of the sliding slot, at least one inner ratchet set on an inner upper sidewall of the conductive head and engageable with the inner ratchet bar, and at least one outer ratchet set on an outer lower sidewall of the conductive head and engageable with the outer ratchet bar.

15. The showcase of claim 14, wherein the inner upper sidewall of the sliding slot comprises an upper inclined portion and an inner portion, the inner lower sidewall of the sliding slot comprises an outer portion and a lower inclined portion, the upper inclined portion is parallel to the lower inclined portion and inclines upwardly relative to the back panel.

16. The showcase of claim 15, wherein the inner ratchet bar is arranged on the inner upper sidewall of the sliding slot, and the outer ratchet bar is arranged on the outer lower sidewall of the sliding slot.

17. The showcase of claim 15, wherein the teeth of the inner rack and the outer rack incline toward an inner end of the sliding slot adjacent to the back panel.

18. The showcase of claim 12, wherein the conductive structure comprises an insulation slot arranged on an upper sidewall of the sliding slot, a positive conductive bar and a negative conductive bar parallel to the positive conductive bar are both set in an inner sidewall of the insulation slot away from the sliding slot; a positive ball and a negative ball are set in an upper sidewall of the conductive head, the positive ball corresponds to and abuts the positive conductive bar, and the negative ball corresponds to and abuts the negative conductive bar.

* * * * *